United States Patent [19]

Warner

[11] 4,103,735

[45] Aug. 1, 1978

[54] HEAT EXCHANGER

[76] Inventor: Albert Woodrow Warner, Rte. 100, Lowell, Vt. 05847

[21] Appl. No.: 720,684

[22] Filed: Sep. 7, 1976

[51] Int. Cl.[2] ..... B60H 1/18; F24H 3/02

[52] U.S. Cl. ..... 165/39; 165/121; 122/20 B; 237/55; 126/104 R; 126/110 R; 165/DIG. 2

[58] Field of Search ..... 165/121, 122, DIG. 2, 165/103, 101, 39, 176, 159, 160; 126/104 R, 110 R, 125, 99 A, 110 B, 121; 122/20 A, 20 B

[56] References Cited

U.S. PATENT DOCUMENTS

| | | | |
|---|---|---|---|
| 1,822,698 | 9/1931 | How | 165/160 |
| 1,910,199 | 5/1933 | Brady | 165/DIG. 2 |
| 2,143,269 | 1/1939 | Hubbard | 165/DIG. 2 |
| 3,813,039 | 5/1974 | Wells | 165/DIG. 2 |
| 3,944,136 | 3/1976 | Huie | 165/DIG. 2 |

*Primary Examiner*—Charles J. Myhre
*Assistant Examiner*—Theophil W. Streule, Jr.
*Attorney, Agent, or Firm*—Thomas N. Neiman

[57] ABSTRACT

This invention is a device for use in increasing the efficiency of existing heating units. This heat exchanger consists of conduits for channeling the furnace or wood stove exhausts in an extended pattern. Cold air is pumped into the heat exchanger at a point at which the exhaust smoke is released up the chimney. The cold air is channeled around the smoke containing flues by a thermostatically-controlled fan and baffles found in the heat exchanger. This air exits the heat exchanger at a point at which the smoke enters it. This heat exchanger puts out temperatures in excess of 450° F. As depicted in the preferred embodiment, only by way of example, the heat exchanger is extremely lightweight and made of galvanized steel with caps at either end to facilitate cleaning.

7 Claims, 5 Drawing Figures

HEAT EXCHANGER

This invention pertains to heat reclaimers and in particular to means for more efficiently using the waste heat products from a furnace or such similar device by the use of a heat exchanger. The normal furnace loses much heat as the hot exhaust smoke is released up the chimney. Prior art is exemplified by U.S. Pat. No. 114,035 issued to James L. Pfau, Jr., on Apr. 25, 1871 for An Improvement in Hot-Air Furnaces, and U.S. Pat. No. 1,706,768 issued to W. A. Brewster, for a Combination Fireplace and Heater on Mar. 26, 1929. Pfau's device puts the exhaust smoke through a chamber before sending it up the chimney. The chamber radiates heat to the room. Brewster's invention contains an air inlet and open tubes which take the heated air into the room by convection. What has been needed is a device to more efficiently use the heat being sent up the chimney. Especially what is needed is an efficient, simple to install and simple to clean unit which will then furnish the heated air to selected areas of the residence by means of attached ductwork.

It is the object of this invention to set forth an improved device or heat exchanger to most efficiently utilize the exhaust heat from a furnace or wood stove, which will much more efficiently and economically save heat than those devices described above.

It is also the aim of this invention to teach a heat exchanger for use with a heating plant or like device having a hot, combustion-products or exhaust-products duct comprising an elongate housing; said housing having an exhaust-products inlet means and an exhaust-products outlet means at one end thereof, for coupling of said means, interpositionally, intermediate the length of an exhaust-products duct of such a heating plant or device, to cause said housing to be supported, in a cantilevered fashion, only at said one end by said exhaust-products duct; first conduit means within said housing, opening onto said inlet means for directing exhaust-products from said one end of said housing to the end opposite; second conduit means within said housing opening onto said outlet means for directing exhaust-products from said opposite end to said one end; means disposed at said opposite end of said housing communicating said first and second conduits for transferring exhaust-products there-between; and means for forcing air into heat-exchanging contact with said conduit means to cause such air to be warmed.

Further objects of this invention, as well as the novel features thereof, will become apparent when one studies the following description of the embodiments of the invention, taken in conjunction with accompanying figures, in which.

Figure 1:
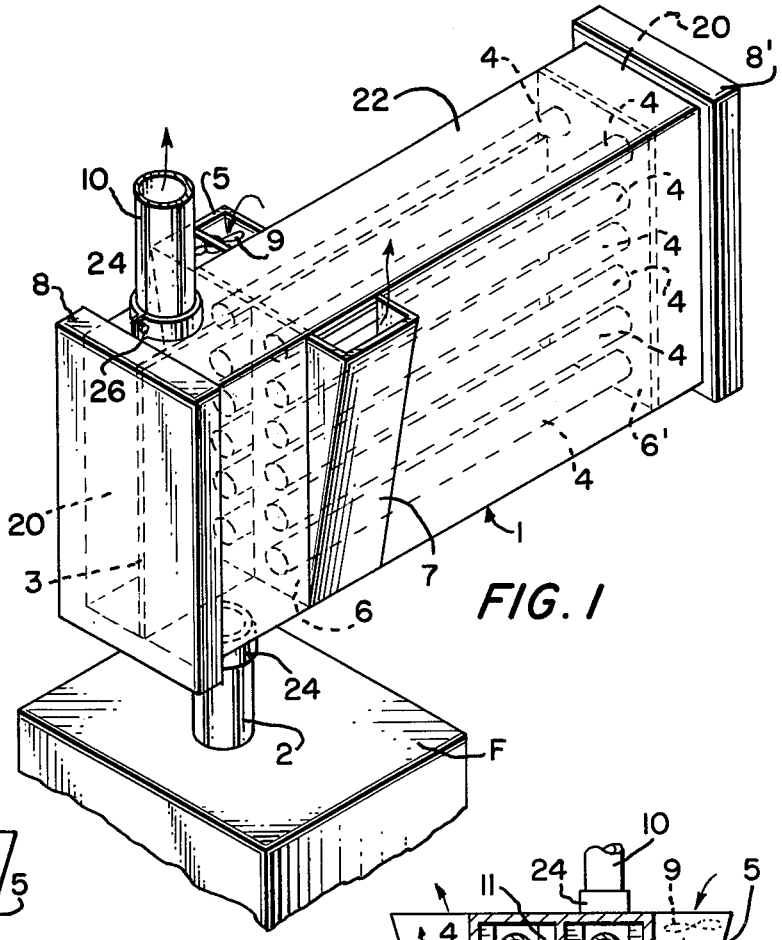
FIG. 1 is an isometric or perspective view of a preferred embodiment of the heat-saving heat exchanger, the same being shown operatively installed with a furnace.

As shown in FIG. 1, the heat exchanger unit 1, according to the preferred embodiment thereof, comprises an exhaust inlet duct 2 which intercepts exhaust smoke from the furnace "F". Inlet 2 is formed in an end housing 20. A plate 3 is placed down the center of the end housing 20, and centrally of a body housing 22, and restricts the exhaust from going directly to a companion outlet duct 10 which, also, is formed in the end housing 20. Conduits 4, which are opened to the exhaust inlet 2, are supported in body housing 22. Conduits 4 conduct the exhaust-products down the entire length of the body housing 22, around at the far end of the housing 22 and back to the other side of the plate 3 to the exhaust outlet duct 10. A cool air inlet duct 5 supports a thermostatically-controlled fan 9 which pulls in air and circulates it around the smoke containing conduits 4. Cross plates 6 and 6' prevent this cool air from entering the end housing 20. It should be noted that the openings for the conduits 4 are located in the cross plates 6 and 6'. The cool air is pumped and circulated around the exhaust-heated conduits down the length of the heat exchanger and back to a heated air exhaust duct 7 which is then connected to further ducting (not shown) to be sent to various locations throughout the home. Other features which should be noted in FIG. 1 are the replaceable end caps 8 and 8' which make the heat exchanger extremely simple to clean. Caps 8 and 8' are only frictionally engaged at opposite ends of the heat exchanger 1. The heat exchanger's construction is lightweight, being formed of thin-guaged galvanized steel; this allows it to be supported at only one end by the exhaust ducting of the furnace "F". It may be advantageous to provide extra support for the opposite end by the use of strapping or a similar means.

Figure 3:
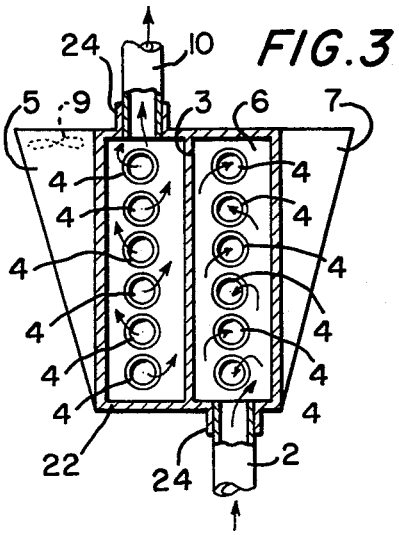
FIG. 3 is an end elevation view, taken along the section 3—3 of FIG. 2, to show a different aspect of the disclosed embodiment of the invention.
Figure 2:
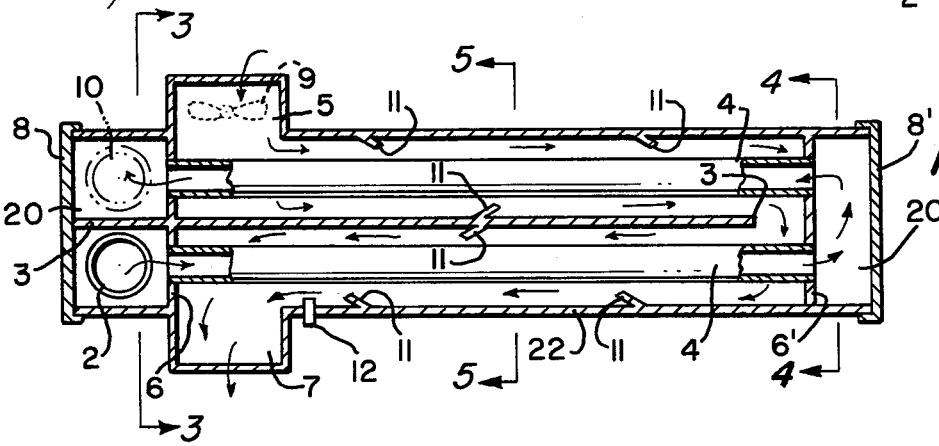
FIG. 2 is a plan or top view, of the FIG. 1 preferred embodiment, with the top cover plates removed for purposes of clarity.

FIG. 2 is the top view of the heat exchanger 1. As mentioned previously, the cool air is pulled in by the fan 9 in the air inlet duct 5. The cross plates 6 and 6' prevent the air from entering the exhaust inlet and outlet chamber, ie. end housing 20. The air is circulated by the fan around the conduits 4, down the length of the body housing 22, and is made to undergo a serpentine motion by means of baffles 11 interspersed along wall surfaces of body housing 22 and plate 3. The fan 9 is controlled by a thermostat 12 located in the heat exchanger or body housing wall just prior or adjacent to air outlet duct 7. FIG. 2 also gives a clearer view of the center plate 3. FIG. 3 is an end view taken from the left side of FIG. 1. It shows a vertical stacking of the conduits 4 and the triangular, air-proportioning, cross-section of the air inlet 5 and outlet 7 ducts.

In the use of the preferred embodiment, the exhaust enters through the exhaust inlet duct 2 and is channeled through the conduits 4 down the length of the heat exchanger and back along the same length again to exhaust outlet duct 10 and up the chimney. Air is pulled in by the fan 9, which is controlled by the thermostat 12, as far as the cross plate 6' and blown around the conduits 4 counter-current to the flow of the exhaust-products. The purpose for this air flow pattern is to heat air continuously as it flows, so that when the heated air reaches a point near the air exhaust duct 7 it comes in contact with conduit that contains the hottest exhaust-products. This produces temperatures in the exhaust air in excess of 450° F. (assuming a typical home furnace operating to produce residential heating of approximately 68° F.). The air pattern is serpentine due to the baffles 11 in the flow stream and this pattern causes maximum contact between air and heated conduits 4.

Figure 4:
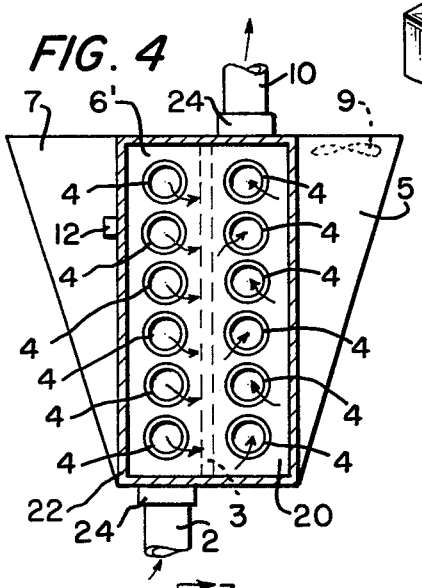
FIG. 4 is a cross-sectional view taken along section 4—4 of FIG. 2.
Figure 5:
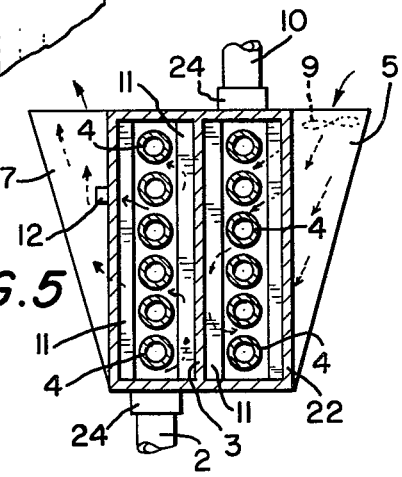
FIG. 5 is a cross-sectional view taken along section 5—5 of FIG. 2.

The heat exchanger 1 is simply coupled to the exhaust-product ducting of the furnace "F" by means of clamping collars 24 (FIGS. 1 and 4) which, in a manner well known in the prior art, have clamping hardware 26 carried thereon — securely to engage the ducting.

Accordingly, while I have described my invention in connection with a specific embodiment thereof, it is clearly to be understood that this is done only by way of example and not as a limitation to the scope of my invention as set forth in the objects thereof and in the claims.

I claim:

1. A heat exchanger, for use with a heating plant or like device having a hot-combustion-products or exhaust-products duct, comprising:

an elongate housing;

said housing having an exhaust-products inlet means and an exhaust-products outlet means at one end thereof, for coupling of said means, interpositionally, intermediate the length of an exhaust-products duct of such a heating plant or device, to cause said housing to be supported, in cantilevered fashion, only at said one end by said exhaust-products duct;

first conduit means, within said housing, opening onto said inlet means for directing exhaust-products from said one end of said housing to the end opposite;

second conduit means, within said housing, opening onto said outlet means for directing exhaust-products from said opposite end to said one end;

means disposed at said opposite end of said housing communicating said first and second conduit means for transferring exhaust-products therebetween;

means for forcing air into heat-exchanging contact with said conduit means to cause such air to be warmed; wherein, said air-forcing means comprises an air inlet means and an air outlet means formed in said housing at said one end, and passageways formed in said housing for moving air through said housing from said air inlet means and to said air outlet means in flow directions which are counter-current to exhaust-products flow directions therethrough;

said first and second conduit means are vertically stacked to provide maximum contact between said conduit means and the air;

said air inlet means has a triangular cross-section with a maximum cross-sectional area thereof being fixed adjacent to the uppermost portion of said vertically stacked second conduit means, and a minimum cross-sectional area thereof being fixed adjacent to the lowermost portion of said vertically stacked second conduit means, to cause said air inlet means to proportion air intake equally across said second conduit means; and said air outlet has a triangular cross-section with a maximum cross-sectional area thereof being fixed adjacent to the uppermost portion of said vertically stacked first conduit means, and a minimum cross-sectional area thereof being fixed adjacent to the lowermost portion of said vertically stacked first conduit means, to cause said air outlet means to proportion air discharge equally across said first conduit means.

2. A heat exchanger, according to claim 1, wherein:

said air-forcing means comprises means for forcing air to move through said housing in counter-current flow directions relative to exhaust-products flow directions.

3. A heat exchanger, according to claim 1, wherein:

said passageways comprise an inlet passageway, and an outlet passageway;

said inlet passageway confines second conduit means therewithin; and said outlet passageway confines said first conduit means therewithin.

4. A heat exchanger, according to claim 1, further including:

air-moving impeller means disposed in at least one of said air inlet and air outlet means.

5. A heat exchanger, according to claim 4, wherein:

said air-moving impeller is controlled by a thermostat located near the air outlet means.

6. A heat exchanger, according to claim 1, wherein:

said housing contains baffle means for causing a serpentine movement of the air.

7. A heat exchanger, according to claim 1, wherein:

said elongate housing has replaceable end caps at both ends to facilitate cleaning of said housing.

* * * * *